US008069805B2

(12) United States Patent
De Baan et al.

(10) Patent No.: US 8,069,805 B2
(45) Date of Patent: Dec. 6, 2011

(54) MOORING CHAIN CONNECTOR ASSEMBLY FOR A FLOATING DEVICE

(75) Inventors: Jacob De Baan, Maassluis (NL); Huibert Van Tol, Hoofddorp (NL); Pieter Cornelis Burger, Zoetermeer (NL)

(73) Assignee: Bluewater Energy Services B.V., Hoofddorp (NL)

( * ) Notice: Subject to any disclaimer, the term of this patent is extended or adjusted under 35 U.S.C. 154(b) by 232 days.

(21) Appl. No.: 12/535,958

(22) Filed: Aug. 5, 2009

(65) Prior Publication Data

US 2010/0031863 A1 Feb. 11, 2010

(30) Foreign Application Priority Data

Aug. 8, 2008 (EP) ..... 08162097

(51) Int. Cl.

| | |
|---|---|
| ***B63B 21/00*** | (2006.01) |
| *B63B 21/08* | (2006.01) |
| *B63B 21/18* | (2006.01) |
| *F16G 13/10* | (2006.01) |

(52) U.S. Cl. ..... 114/230.26; 114/180; 114/200; 59/95

(58) Field of Classification Search ..... 114/200, 114/230.2, 179, 180, 199, 293, 294, 210, 114/230.1; 59/89, 95, 85, 88, 93
See application file for complete search history.

(56) References Cited

U.S. PATENT DOCUMENTS

| | | | | |
|---|---|---|---|---|
| 357,944 | A * | 2/1887 | Stout | 24/611 |
| 458,855 | A * | 9/1891 | Meinzer | 254/395 |
| 838,286 | A * | 12/1906 | Tomlin | 114/180 |
| 1,101,158 | A * | 6/1914 | Wilde | 280/451 |
| 1,429,518 | A * | 9/1922 | McMahon | 198/707 |
| 1,597,150 | A * | 8/1926 | Goddard | 59/89 |

(Continued)

FOREIGN PATENT DOCUMENTS

| | | |
|---|---|---|
| EP | 1849701 | 10/2007 |

(Continued)

OTHER PUBLICATIONS

Official Search Report of the European Patent Office in counterpart foreign application No. EP 08162097 filed Aug. 8, 2008.

*Primary Examiner* — Daniel Venne
*Assistant Examiner* — Andrew Polay
(74) *Attorney, Agent, or Firm* — Steven M. Koehler; Westman, Champlin & Kelly, P.A.

(57) ABSTRACT

A mooring chain connector assembly for a floating device), such as for example a FPSO vessel or a floating offshore structure, is described, the connector assembly comprising a chain connector having a first pivot axis and a coupler for coupling a mooring chain to the chain connector. The assembly further comprises a channel assembly attached to the floating device. The channel assembly have an upper end and a lower end, wherein mooring chain locking device is provided at the upper end of the channel assembly. The channel assembly extends in the floating device from its bottom side to a higher level in the floating device which can be located above sea surface. A bearing location for the first pivot axis of the chain connector is provided at the lower end of the channel assembly. The chain connector is movable in the channel assembly and a hoist is provided to move the chain connector between a first position, in which the first pivot axis is located in the bearing location of the channel assembly and a second position above the channel assembly, in which the coupler of the chain connector is accessible.

20 Claims, 8 Drawing Sheets

U.S. PATENT DOCUMENTS 1,618,851 A * 2/1927 Thunberg et al. ..... 403/165
1,912,366 A * 6/1933 Hausenfluck ..... 114/210
2,434,318 A * 1/1948 Haubert ..... 59/95
2,824,421 A * 2/1958 Nelson ..... 59/85
3,137,049 A * 6/1964 Noble ..... 24/370
3,160,024 A * 12/1964 Mojonnier ..... 474/212
3,270,494 A * 9/1966 Holmes ..... 59/86
3,289,626 A * 12/1966 Petrie et al. ..... 114/200
3,329,120 A * 7/1967 Lindberg ..... 114/180
3,521,443 A * 7/1970 Dragonuk ..... 59/86
4,060,978 A * 12/1977 McBain et al. ..... 59/78
4,561,797 A * 12/1985 Aldridge ..... 403/58
4,567,840 A * 2/1986 Arlt et al. ..... 114/180
4,600,331 A * 7/1986 Gray ..... 403/165
4,612,869 A * 9/1986 Poppe ..... 114/293
4,650,431 A * 3/1987 Kentosh ..... 441/5
4,940,362 A * 7/1990 Paulshus et al. ..... 405/223.1
5,097,787 A * 3/1992 Bruce ..... 114/293
5,240,446 A * 8/1993 Boatman et al. ..... 441/3
5,244,243 A * 9/1993 Grayson et al. ..... 294/89
5,292,271 A * 3/1994 Boatman et al. ..... 441/3
5,305,594 A * 4/1994 Wang ..... 59/85
5,316,509 A * 5/1994 Boatman et al. ..... 441/3
5,356,321 A * 10/1994 Boatman et al. ..... 441/3
5,363,789 A * 11/1994 Laurie et al. ..... 114/293
5,372,531 A * 12/1994 Boatman et al. ..... 441/4
5,399,042 A * 3/1995 Ivel ..... 403/165
5,461,820 A * 10/1995 Sorola ..... 43/43.1
5,607,248 A * 3/1997 Hasse ..... 403/78
5,823,131 A * 10/1998 Boatman et al. ..... 114/230.12
5,862,771 A * 1/1999 Lange et al. ..... 114/293
5,934,216 A * 8/1999 Childers et al. ..... 114/230.1
6,070,548 A * 6/2000 Ducousso et al. ..... 114/293
6,148,755 A * 11/2000 Wudtke et al. ..... 114/230.2
6,418,871 B1 * 7/2002 Simon ..... 114/293
6,446,568 B1 * 9/2002 Hystad ..... 114/199
6,484,659 B2 * 11/2002 Hobdy et al. ..... 114/230.1
6,564,740 B1 * 5/2003 Hobdy et al. ..... 114/230.12
6,631,745 B2 * 10/2003 Fontenot et al. ..... 141/279
6,663,320 B1 * 12/2003 Braud et al. ..... 405/224
6,719,497 B1 * 4/2004 Pollack et al. ..... 405/224
6,925,890 B2 * 8/2005 Fontenot ..... 73/828
7,000,556 B2 * 2/2006 Gundersen ..... 114/180
7,325,508 B2 * 2/2008 Boatman et al. ..... 114/230.2
7,392,757 B2 * 7/2008 Niebur ..... 114/200
7,395,771 B2 * 7/2008 Maloberti ..... 114/293
7,510,452 B2 * 3/2009 Van Tol et al. ..... 441/5
7,513,208 B1 * 4/2009 Seaman et al. ..... 114/230.12
7,926,436 B2 * 4/2011 Boatman et al. ..... 114/230.2
2004/0055522 A1 * 3/2004 Boatman et al. ..... 114/230.12
2005/0061224 A1 3/2005 Boatman
2007/0220858 A1 * 9/2007 Maloberti ..... 59/93
2008/0289559 A1 * 11/2008 De Baan ..... 114/230.12

FOREIGN PATENT DOCUMENTS

EP 2154059 A1 * 2/2010
GB 2250006 A * 5/1992
GB 2351058 12/2000
GB 2351058 A * 12/2000
GB 2443618 5/2008
GB 2443618 A * 5/2008
GB 2449488 A * 11/2008
WO WO03004347 1/2003

* cited by examiner

MOORING CHAIN CONNECTOR ASSEMBLY FOR A FLOATING DEVICE

BACKGROUND

The discussion below is merely provided for general background information and is not intended to be used as an aid in determining the scope of the claimed subject matter.

Aspects of the invention relate to a mooring chain connector assembly for a floating device, such as for example a FPSO (Floating Production Storage and Offloading) vessel or a floating offshore structure, comprising a chain connector having a first pivot axis, and a coupler for coupling a mooring chain to the chain connector, the assembly further comprising a channel assembly attached to the floating device, the channel assembly having an upper end and a lower end, wherein a mooring chain locking device is provided at the upper end of the channel assembly.

As is known generally, floating devices such as vessels or floating offshore structure, for example in the oil and gas industry, are moored to the seabed with one or more mooring lines. The floating device is kept on location because of the catenary effect of the mooring chains. A shift of the floating device leads to a lifting or lowering of the mooring chains, which leads to a counter effect striving to re-establish the original position of the floating device. The floating device is provided with a mooring chain connector assembly for each mooring chain, wherein the first pivot axis allows motions of the mooring chain in its catenary plane (so-called "in-plane motions"). It is also known to provide a second pivot axis, typically perpendicular to the first pivot axis, which second axis allows motions of the mooring chains in a transverse direction (so-called "out-of-plane motions"). In this manner fatigue problems in the mooring chain related to any motions of the mooring chain are minimized.

Mooring chain connector assemblies of this type are described for example in GB-A-2 351 058, GB-A-2 443 618 and US-A-2006/0213418. In the known mooring chain connector assemblies the connection of a mooring chain is a complicated operation taking place below sea surface. This operation requires either the presence of divers or a remote operated vehicle below sea surface near the bottom side of the floating device.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

According to an aspect of the invention, a mooring chain connector assembly includes a channel assembly that extends in the floating device from its bottom side to a higher level in the floating device which can be located above the sea surface, wherein a bearing location for the first pivot axis of the chain connector is provided at the lower end of the channel assembly, wherein the chain connector is movable in the channel assembly and wherein a mover is provided to move the chain connector between a first position, in which the first pivot axis is located in the bearing location of the channel assembly and a second position above the channel assembly, in which the coupler of the chain connector is accessible.

In this manner a mooring chain connector assembly is provided, which allows the operations for connecting a mooring chain to take place above the sea surface. For connection of a mooring chain, the movable chain connector is located in its second position and the mooring chain is pulled in through the channel assembly and locked by the mooring chain locking device at the upper end of the channel assembly. It is noted that the operations for pulling in a mooring chain are conventional and need not to be described further. When the mooring chain is locked by the mooring chain locking device chain links can be removed to obtain the required mooring chain length and the end link can be connected to the coupler of the chain connector. Thereafter the chain connector can be lowered into the channel assembly into its first position to locate the first pivot axis in the bearing location below the sea surface. It is noted that it is not necessary that the upper end of the channel assembly at the higher level in the floating device is continuously located above sea surface. During connection operations of the mooring chains to the floating device, the floating device can be trimmed such that the higher level of the channel assembly is located above sea surface.

According to an embodiment of the invention, the chain connector comprises an upper pivot part having journals at opposite ends determining the first pivot axis, wherein the channel assembly is provided with first guiding elements for guiding the journals of the chain connector during moving the chain connector in the channel assembly, the first guiding elements extending between the upper and lower ends of the channel assembly, wherein the lower ends of the guiding elements provide the bearing location for the journals. In this manner the chain connector can be moved in the channel assembly in an easy manner wherein the first pivot axis is automatically received in the bearing location during lowering the chain connector into the channel assembly.

In an embodiment of the invention the channel assembly comprises an outer wall with an outwardly flaring ramp part at its lower end, wherein the coupler is coupled to the upper pivot part through a lever arm pivotally connected to the upper pivot part and the coupler around pivot axes parallel to the first pivot axis. The lever arm pivotally connected between the upper pivot part and the coupler allows the coupler of the chain connector to follow the ramp part of the channel assembly during movement of the chain connector to the bearing location in the channel assembly.

In an embodiment, wherein the chain connector comprises a lower pivot part pivotally connected to the upper pivot part around a second pivot axis, the lever arm is pivotally connected to the lower pivot part, wherein in case of motions of the mooring chain, the friction forces at the pivot points between the mooring chain, the coupler, the lever arm and the lower pivot part in combination with the length of the lever arm result in rotation of the first and/or second pivot axis. In this manner motions of the mooring chain are mainly accommodated in the pivot axes of the chain connector, so that fatigue problems are minimized.

BRIEF DESCRIPTION OF THE DRAWINGS

Aspects of the invention will be further explained by reference to the drawing schematically showing an embodiment of the mooring chain assembly.

DETAILED DESCRIPTION OF THE ILLUSTRATIVE EMBODIMENTS

Figure 1:
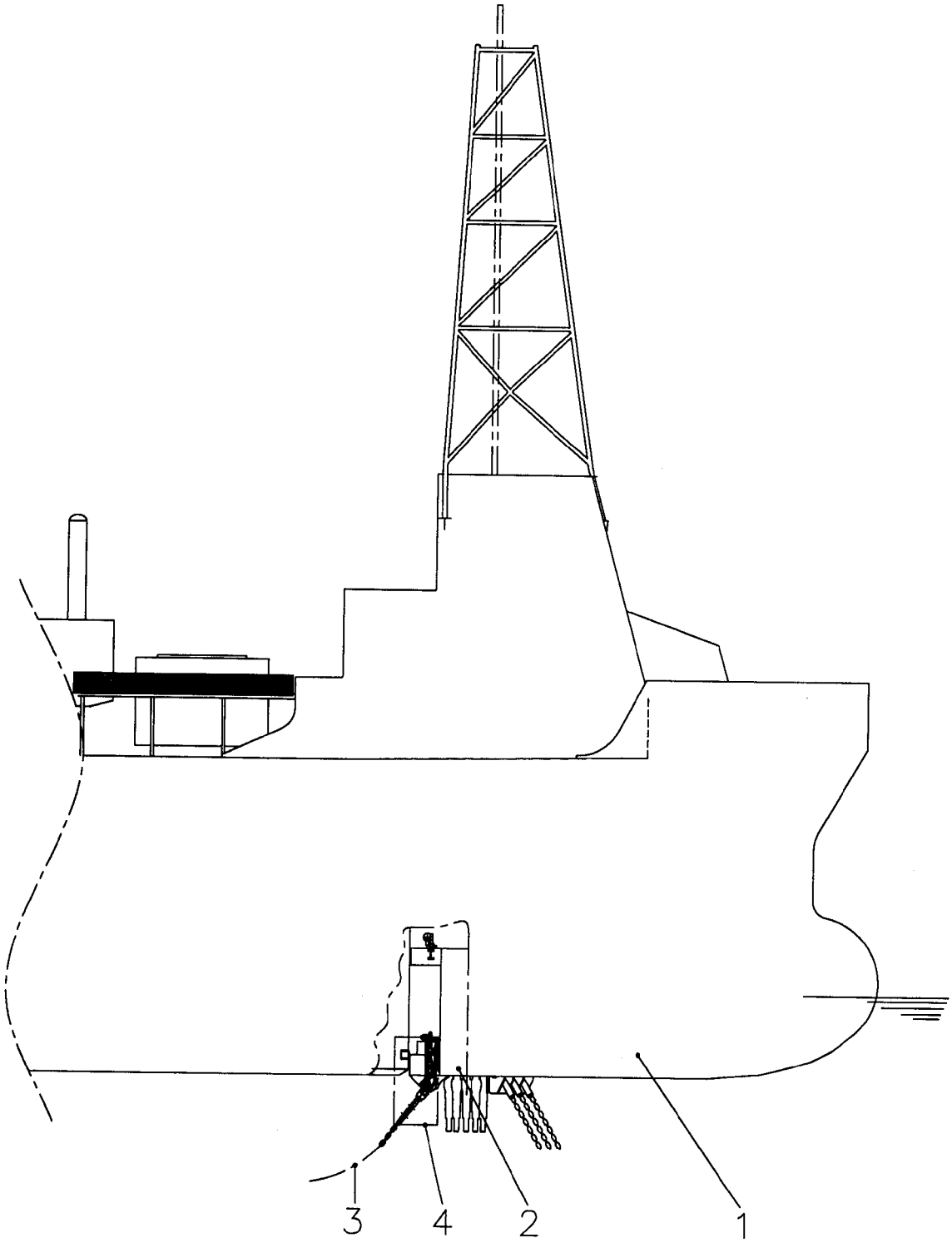
FIG. 1 schematically shows a bow part of a FPSO vessel having a turret anchored to the seabed, wherein an embodiment of the mooring chain assembly is used to connect the mooring chains to the bottom side of the turret.

FIG. 1 schematically shows the bow part of a so-called FPSO vessel 1, comprising a turret 2, which is anchored to the seabed by means of a plurality of mooring lines 3 in a usual manner. The FPSO vessel 1 is adapted to weathervane around the turret 2. It is noted that the wording mooring chain and mooring line as used in the specification and claims may be any type of mooring means such as chains, wires, a combination thereof or the like. Each mooring line 3 is connected to the turret 2 by means of a mooring chain connector assembly 4 having two mainly perpendicular pivot axes to accommodate motions of the mooring line in its catenary plane (in-plane motions) and transverse to this plane (out-of-plane motions). In this manner fatigue problems which may lead to failure of the line are minimized.

Figure 2:
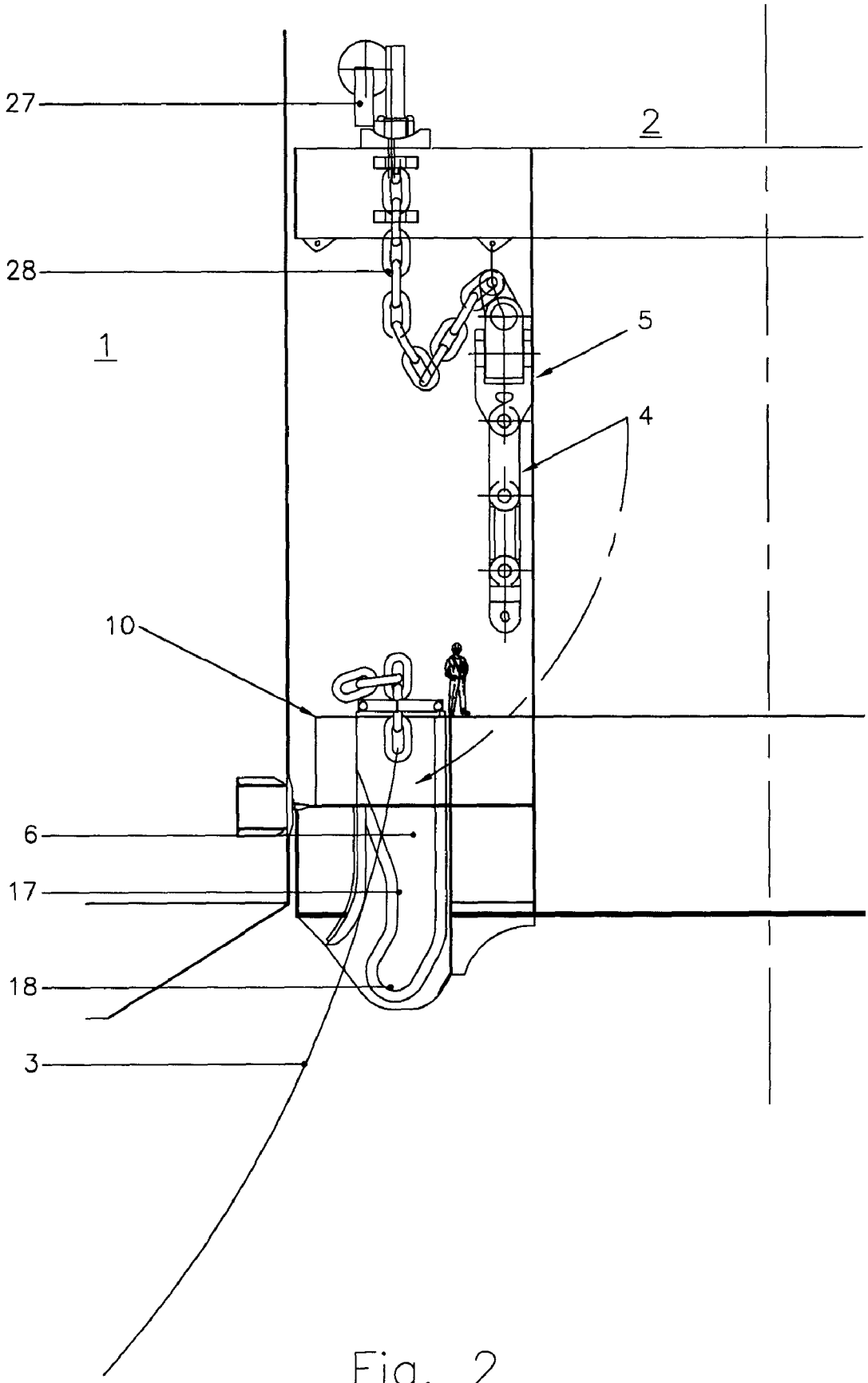
FIG. 2 is a cross section of a part of the turret of FIG. 1 at a larger scale, schematically showing the mooring chain assembly of FIG. 1 with the chain connector in its second position above the channel assembly.
Figure 3:
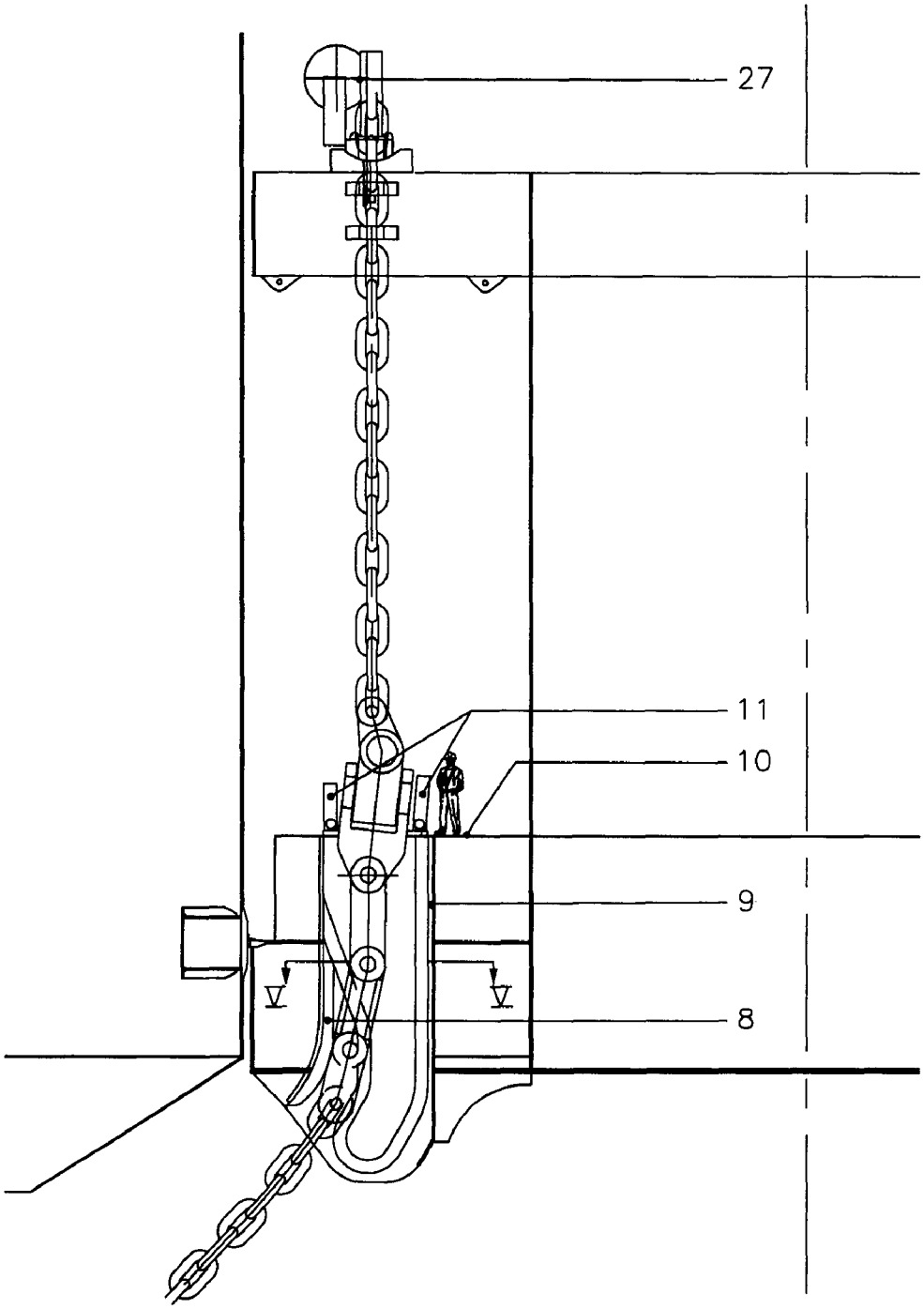
FIG. 3 is a cross section corresponding to FIG. 2, wherein the chain connector is in a position intermediate the first and second positions.
Figure 4:
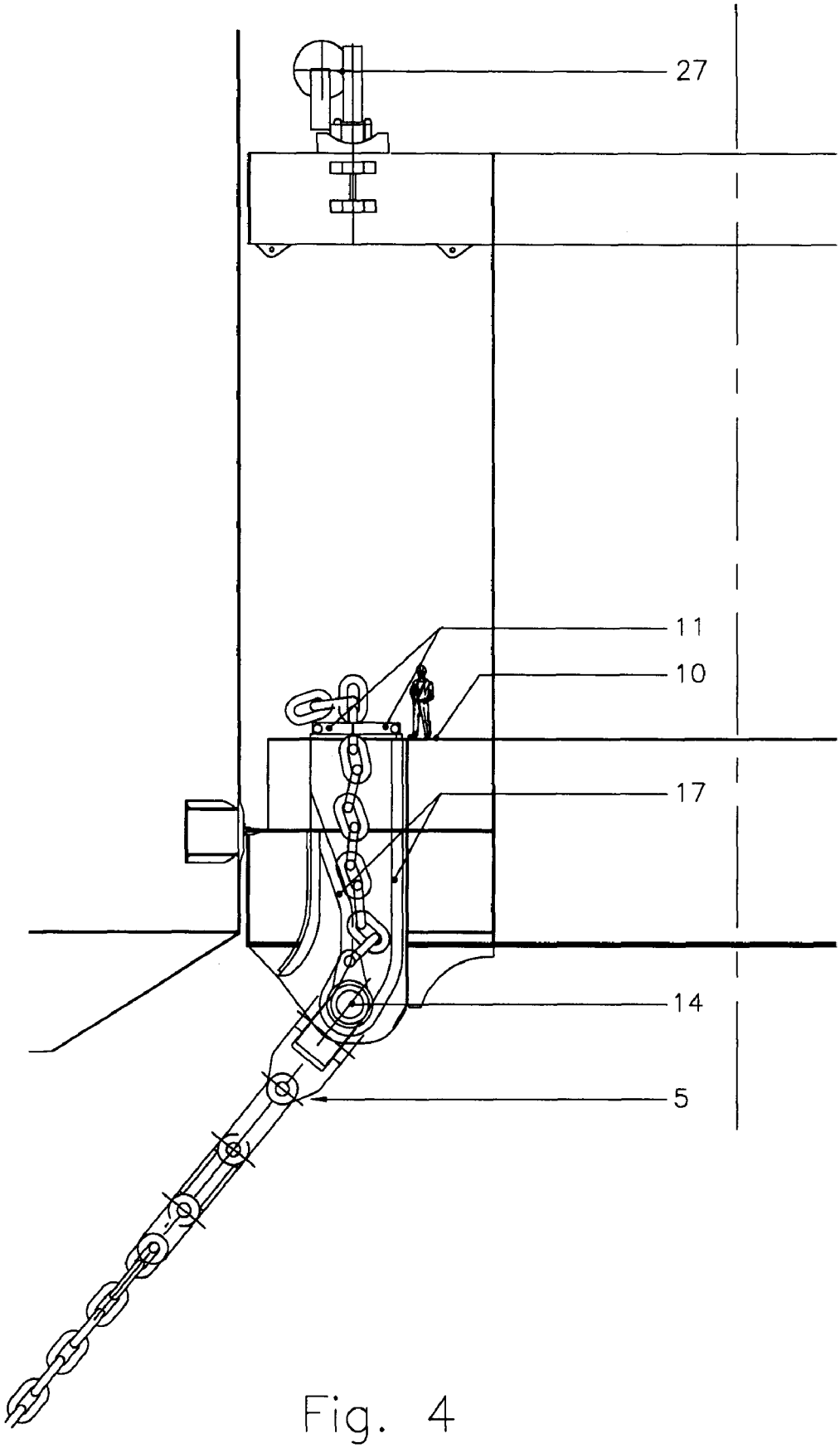
FIG. 4 is a cross section corresponding to FIGS. 2 and 3, wherein the chain connector is in its first position.
Figure 5:
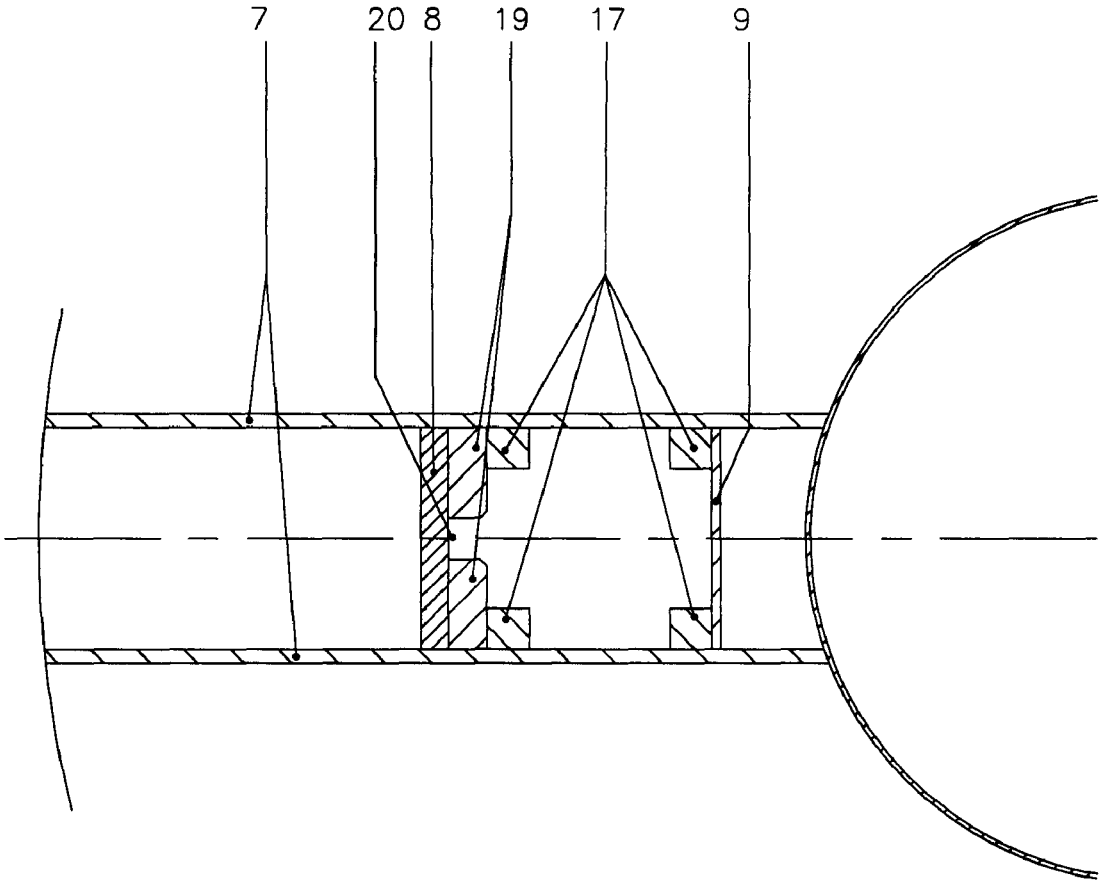
FIG. 5 is a cross section according to the plane V-V in FIG. 3.
Figure 6:
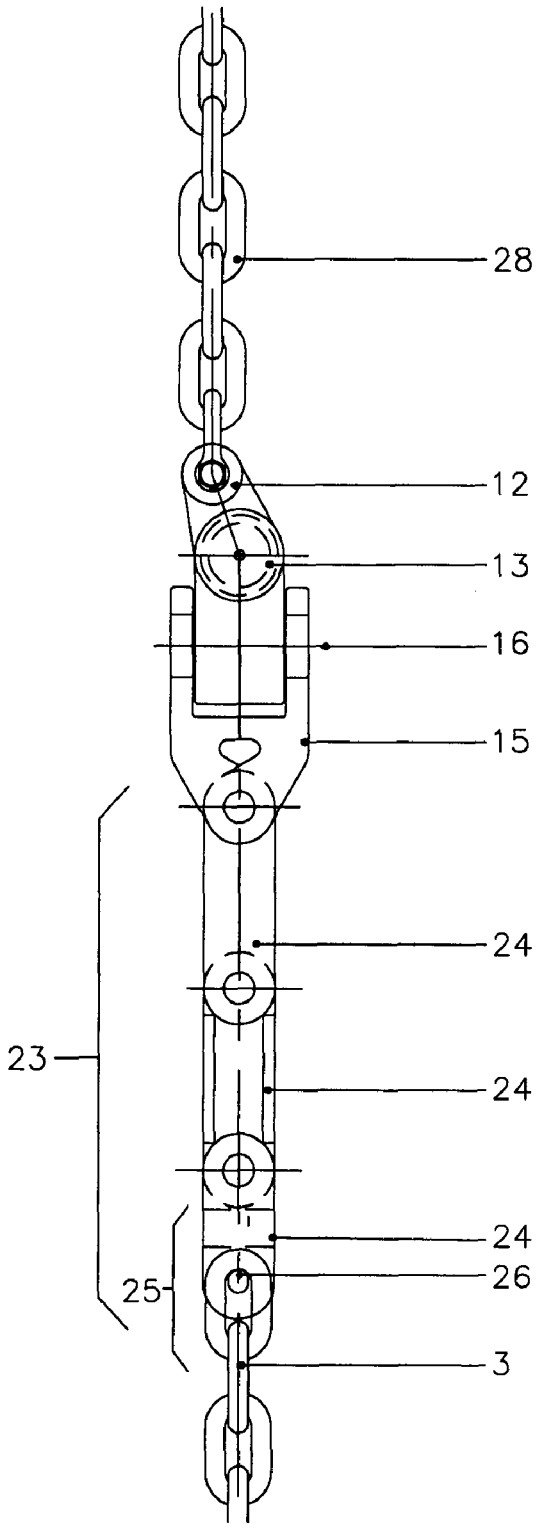
FIGS. 6 and 7 are side and front views of the chain connector of the mooring chain assembly of FIGS. 2-4.
Figure 7:
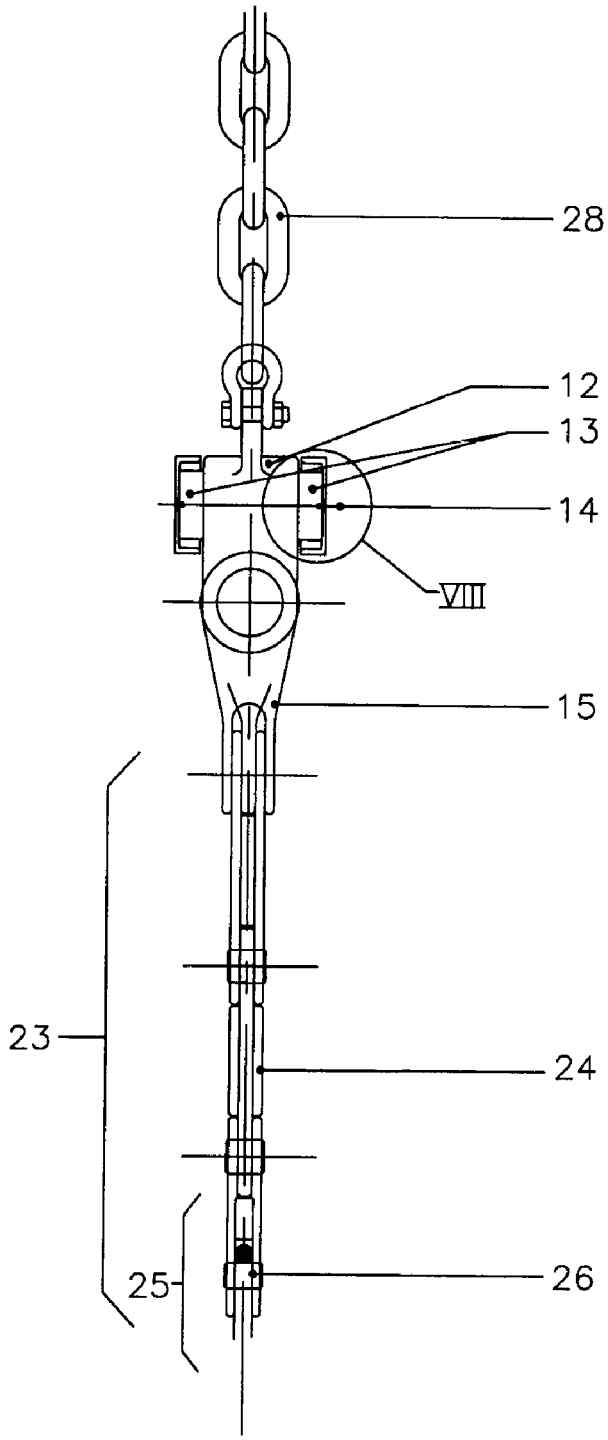
Figure 8:
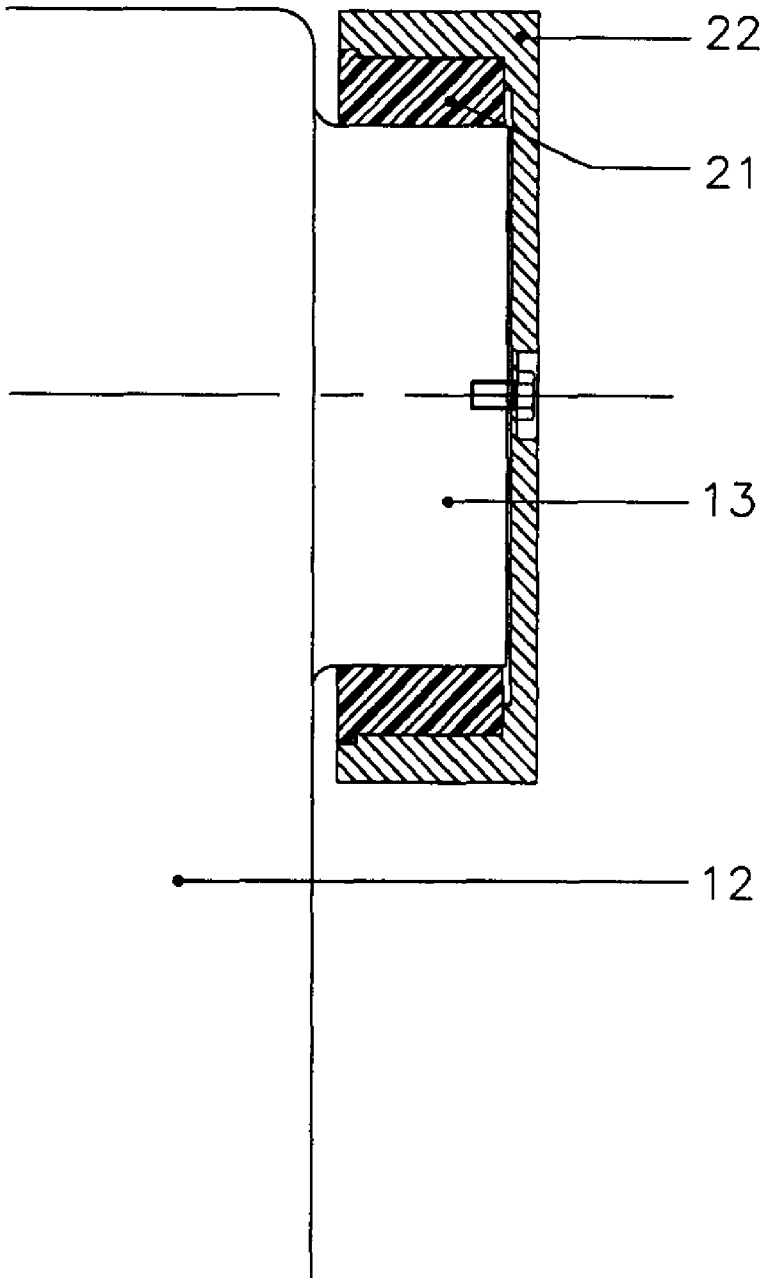
FIG. 8 shows detail VIII of FIG. 7 with a journal of the chain connector of FIGS. 6 and 7 at a larger scale.

The mooring chain connector assembly 4 is shown at a larger scale in FIGS. 2-4 and comprises a chain connector 5 shown in more detail in FIGS. 6-8 and a substantially vertically extending channel assembly 6 attached to the turret 4. As can be seen in FIG. 5 the channel assembly 6 includes two radial plates 7 and two transverse plates 8,9, wherein these plates 7-9 determine a channel extending from the bottom side of the turret 2 to a higher level inside the turret 2. This higher level can be located above sea surface by trimming the vessel 1 accordingly. The bottom side of the turret 2 will typically be located below sea surface during normal use. At the upper end the channel assembly 6 ends at an installation deck 10, where mooring chain locking device 11 is provided. This locking device 11 comprise for example locking levers adapted to cooperate with chain links and biased to the position shown in FIGS. 2 and 4 and known per-se. Against the bias the locking levers may pivot upwardly to allow an upward shift of the mooring line 3 while preventing a reverse movement. The locking levers may be fixed by suitable means, such as a hydraulic or mechanical device, in this open position to introduce the chain connector 5 into the channel assembly 6 as shown in FIG. 3. Other forms of locking devices having one or more elements that selectively engage one or more of the chain links can be used.

The chain connector 5 comprises an upper pivot part 12 having a journal 13 at opposite sides as shown in FIG. 7. The journals 13 determine a first pivot axis 14 of the chain connector 5 and thereby of the chain connector assembly 4. The upper pivot part 12 is pivotally connected to a lower pivot part 15 and this pivotable connection determines the second pivot axis 16 (FIG. 6) of the chain connector 5 and the chain connector assembly 4, respectively. The first and second pivot axes 14,16 are preferably perpendicular; it is however possible to have the pivot axes at a mutually different angle.

The channel assembly 6 is provided with first guiding elements 17 extending from the installation deck 10 to the bottom side of the turret 2. These guiding elements 17 are made as guiding rails typically mounted on the radial plates 7, wherein the guiding elements 17 provide a bearing location 18 for each journal 13 at their lower ends. Near the lower ends the guiding elements 17 may likely have an outwardly directed section oriented towards the upper part of the corresponding mooring chain. The outer transverse plate 8 flares outwards in a corresponding manner and provides in this manner an outwardly directed chain ramp part. This outer plate 8 is provided with second guiding elements 19 for a mooring line 3. These second guiding elements 19 are made as strips determining a slot 20 in which the chain links of a mooring line 3 can be received.

As shown in FIGS. 7 and 8 each journal 13 is provided with an inner ring 21 made of a low friction material, such as for example bronze or a synthetic material. This low friction inner ring 21 is protected by an outer ring 22 of a wear resistant material, for example steel. In one embodiment outer ring 22 is circular shaped on the circumference to potentially act as roller during movement of chain connector 5 through channel assembly 6.

The chain connector 5 further comprises a lever arm 23 which in the embodiment shown includes three elements 24. The lower element 24 acts as a coupler 25 for coupling the mooring line 3 to the chain connector 5. In the embodiment shown the upper chain link of the line 3 is coupled to the coupling means 25 by a pin 26.

Connecting a mooring line 3 to the mooring chain connector assembly 4 as described shows the significant advantage that all operations may take place above the sea surface so that divers or a remote operated vehicle are not required. In a first step the mooring line 3 to be connected is pulled through the channel of the channel assembly 6 by means of a hoisting device 27 located at a level above the installation deck 10. This step of pulling in the mooring line 3 can include use of the hoisting device 27, but is otherwise known per se and is not further described. The chain links of the line 3 can pass the locking device 11 and as soon as a sufficient number of chain links have passed the locking device 11 to obtain the desired position of the mooring line 3 after installation, the line 3 is disengaged from the hoisting device 27. The locking device 11 maintains the line 3 in its pulled-in position. Any superfluous chain links of the mooring line 3 can be removed.

During pulling in the mooring line 3, the chain connector 5 is in a second or storage position located above the channel assembly 6 and the installation deck 10. It will be clear that the exact location of this second position is not critical. As shown in FIG. 2 a lifting chain 28 connected to the upper pivot part 12 is coupled to a mover such as the hoisting device 27, or another hoist, and/or an actuator. It is noted that lifting chain 28 may have formed part of mooring line 3. The upper chain link of the mooring line 3 is connected to the coupler 25 and after opening and securing the locking device 11 against the bias, such as through positioning, lifting and tensioning the chain connector 5 that now connects the hoisting device 27 with the mooring line 3, the hoisting device 27 lowers the chain connector 5 into the channel assembly 6. During this movement the journals 13 with the protection ring 22 are received in the first guiding elements 17 having a widened entrance at their upper ends. During lowering the chain connector 5 into the channel assembly 6 the lever arm elements 24 allow the coupler 25 to follow the chain ramp part of the outer wall 8 and the path of the mooring line 3. FIG. 3 shows the chain connector 5 in an intermediate position, wherein the upper pivot part 12 lies at the level of the installation deck 10 at the entrance of the guiding elements 17. In FIG. 4 the chain connector 5 is in its first or operative position, in which the journals 13 are received in the bearing locations 18. The lifting chain 28 is partly received in the channel assembly 6 and the locking device 11 are in their biased or chain engaging position.

These operations are repeated for the other mooring lines 3. In case one or more mooring lines need to be shortened, the hoisting device 27 can easily lift the chain connector 5 above the installation deck 10 so that one or more chain links can be removed from the mooring line 3. The same applies in case a mooring line 3 needs to be replaced.

The chain connector 5 with the mutually perpendicular pivot axes 14 and 16 accommodates both in-plane and out-of-plane motions of the mooring line 3. In case of motions of the mooring line the friction forces at the pivot points between the mooring chain, the coupler, the lever arm and the lower pivot part in combination with the length of the lever arm result in rotation of the first pivot axis 14 in the bearing location 18, in particular of the journals 13 in the inner rings 21 and/or rotation of the second pivot axis 16. By means of a relative low friction at the bearing location and a sufficient length of the lever arm any remaining moments in the upper end of the mooring line can be significantly reduced. The length of the lever arm 23 can be determined in accordance with the specific design of the intended application. This also applies to the number of lever elements 24.

From the above it will be clear that aspects of the invention includes a mooring chain connector assembly with a chain connector mounted in a removable manner in the channel assembly. This construction shows the advantage of providing two pivot axes for accommodating both in-plane and out-of-plane motions in combination with a compact construction and easy access to the coupler. It will be understood that although the mooring chain connector assembly is described in an embodiment mounted in a FPSO vessel, the mooring chain connector assembly can be used in other vessel types or floating offshore structures. Further, it is observed that the invention can also be applied in embodiments wherein the chain connector is provided with one pivot axis. In the embodiment described a typical catenary mooring line is shown. It is noted however that aspects of the invention can also be applied for taut mooring lines.

Although the subject matter has been described in a language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

The invention claimed is:

1. A mooring chain connector assembly for a floating device, the assembly comprising:

a chain connector having a first pivot axis;

a coupler arranged to couple a mooring chain to the chain connector;

a channel assembly attached to the floating device, the channel assembly having an upper end and a lower end, wherein the channel assembly extends in the floating device from a lower level to a higher level in the floating device, wherein a bearing location for the first pivot axis of the chain connector is provided at the lower end of the channel assembly, wherein the chain connector is movable in the channel assembly, and wherein the channel assembly comprises first guiding elements extending between the upper and lower end of the channel assembly, the first guiding elements being configured to guide the chain connector between a first position, in which the first pivot axis is located in the bearing location of the channel assembly and a second position above the channel assembly wherein the coupler of the chain connector is accessible, and the first guiding elements being configured to stop downward movement of the first pivot axis at the bearing location;

a mover configured to move the chain connector between the first position and the second position; and a mooring chain locking device provided at the upper end of the channel assembly.

2. The mooring chain connector assembly according to claim 1, wherein the chain connector comprises an upper pivot part having journals at opposite ends determining the first pivot axis, wherein the first guiding elements are arranged to guide the journals of the chain connector while the chain connector moves in the channel assembly, wherein lower ends of the first guiding elements provide the bearing locations for the journals.

3. The mooring chain connector assembly according to claim 2, wherein the channel assembly comprises an outer wall with an outwardly flaring ramp part at a lower end, wherein the coupler is coupled to the upper pivot part through a lever arm pivotally connected to the upper pivot part and the coupler around pivot axes parallel to the first pivot axis.

4. The mooring chain connector assembly according to claim 1, wherein the chain connector comprises a lower pivot part pivotally connected to the upper pivot part around a second pivot axis.

5. The mooring chain connector assembly according to claim 4, wherein the lever arm is pivotally connected to the lower pivot part, wherein in case of motions of the mooring chain the friction forces at the pivot points between the mooring chain, the coupler, the lever arm and the lower pivot part in combination with the length of the lever arm result in rotation of the first and/or second pivot axis.

6. The mooring chain connector assembly according to claim 2, wherein each journal is provided with an inner bearing ring and a protection outer ring disposed about the inner ring and adapted to engage the first guiding elements and move with respect to the corresponding journal.

7. The mooring chain connector assembly according to claim 1, wherein the channel assembly is provided with second guiding elements for a mooring chain, wherein the mooring chain locking device is located at the upper end of the first and second guiding elements.

8. The mooring chain connector assembly according to claim 7, wherein the mover comprises a lifting chain connected to the upper pivot part and adapted to cooperate with the mooring chain locking device.

9. The mooring chain connector assembly according to claim 8, wherein the mover comprises a hoisting device adapted to be coupled with the lifting chain and the mooring chain.

10. A floating device comprising a plurality of mooring chain connector assemblies, each mooring chain connector assembly comprising:

a chain connector having a first pivot axis;

a coupler arranged to couple a mooring chain to the chain connector;

a channel assembly having an upper end and a lower end, wherein the channel assembly extends in the floating device from a lower level to a higher level in the floating device, wherein a bearing location for the first pivot axis of the chain connector is provided at the lower end of the channel assembly, wherein the chain connector is movable in the channel assembly, and wherein the channel assembly comprises first guiding elements extending between the upper and lower end of the channel assembly, the first guiding elements being configured to guide the chain connector between a first position, in which the first pivot axis is located in the bearing location of the channel assembly and a second position above the channel assembly wherein the coupler of the chain connector is accessible, the first guiding elements being configured to stop downward movement of the first pivot axis at the bearing location;

a mover configured to move the chain connector between the first position and the second position; and a mooring chain locking device provided at the upper end of the channel assembly.

11. The floating device according to claim 10 wherein the floating device comprises a FPSO (Floating Production Storage and Offloading) vessel.

12. The floating device according to claim 10, wherein the chain connector comprises an upper pivot part having journals at opposite ends determining the first pivot axis, wherein the first guiding elements are arranged to guide the journals of the chain connector during moving the chain connector in the channel assembly, wherein lower ends of the first guiding elements provide the bearing locations for the journals.

13. The floating device according to claim 12, wherein the channel assembly comprises an outer wall with an outwardly flaring ramp part at a lower end, wherein the coupler is coupled to the upper pivot part through a lever arm pivotally connected to the upper pivot part and the coupler around pivot axes parallel to the first pivot axis.

14. The floating device according to claim 10, wherein the chain connector comprises a lower pivot part pivotally connected to the upper pivot part around a second pivot axis.

15. The floating device according to claim 14, wherein the lever arm is pivotally connected to the lower pivot part, wherein in case of motions of the mooring chain the friction forces at the pivot points between the mooring chain, the coupler, the lever arm and the lower pivot part in combination with the length of the lever arm result in rotation of the first and/or second pivot axis.

16. The floating device according to claim 12, wherein each journal is provided with an inner bearing ring and a protection outer ring disposed about the inner ring and adapted to engage the first guiding elements and move with respect to the corresponding journal.

17. The floating device according to claim 10, wherein the channel assembly is provided with second guiding elements for a mooring chain, wherein the mooring chain locking device is located at the upper end of the first and second guiding elements.

18. The floating device according to claim 17, wherein the mover comprises a lifting chain connected to the upper pivot part and adapted to cooperate with the mooring chain locking device.

19. The floating device according to claim 18, wherein the mover comprises a hoisting device adapted to be coupled with the lifting chain and the mooring chain.

20. A mooring chain connector assembly for a floating device, the assembly comprising:

a chain connector having a first pivot axis;

a coupler arranged to couple a mooring chain to the chain connector;

a channel assembly attached to the floating device, the channel assembly having an upper end and a lower end, wherein the channel assembly extends in the floating device from a lower level to a higher level in the floating device, wherein the chain connector is movable in the channel assembly, wherein a bearing location for the first pivot axis of the chain connector is provided at the lower level of the channel assembly, and wherein the channel assembly is configured to stop downward movement of the first pivot axis at the bearing location; and a plurality of journals connected at opposite ends of an upper pivot part, wherein each journal is configured to determine the first pivot axis, and wherein each journal is provided with an inner bearing ring and a protection outer ring disposed about the inner ring and adapted to engage a portion of the channel assembly and moves with respect to the corresponding journal.

* * * * *